US011472623B2

(12) United States Patent
Maurizio

(10) Patent No.: US 11,472,623 B2
(45) Date of Patent: Oct. 18, 2022

(54) DEVICE FOR PROTECTING FRANGIBLE ARTICLES

(71) Applicant: Pasini Pier Maurizio S.r.l., Castelnuovo Scrivia (IT)

(72) Inventor: Pasini Pier Maurizio, Castelnuovo Scrivia (IT)

(73) Assignee: Pasini Pier Maurizio S.r.l., Scrivia (IT)

( * ) Notice: Subject to any disclaimer, the term of this patent is extended or adjusted under 35 U.S.C. 154(b) by 0 days.

(21) Appl. No.: 16/889,875

(22) Filed: Jun. 2, 2020

(65) Prior Publication Data

US 2020/0385190 A1 Dec. 10, 2020

(30) Foreign Application Priority Data

Jun. 4, 2019 (IT) ..... 102019000007968

(51) Int. Cl.
*B65D 71/50* (2006.01)
*B65D 81/02* (2006.01)
*B65D 85/30* (2006.01)

(52) U.S. Cl.
CPC ..... *B65D 81/022* (2013.01); *B65D 85/30* (2013.01)

(58) Field of Classification Search
CPC . A45C 2003/002; A45C 2200/20; A45C 9/00; A45C 3/045; A47G 23/02; A47G 23/0303; A47G 23/0216
USPC ..... 206/150, 151, 427; 294/87.2, 159
See application file for complete search history.

(56) References Cited

U.S. PATENT DOCUMENTS

| | | | | |
|---|---|---|---|---|
| 3,128,895 | A | 4/1964 | Nelle | |
| 9,301,594 | B1 * | 4/2016 | Scior | A45C 3/045 |
| 2009/0045081 | A1 | 2/2009 | Hamann | |
| 2012/0008885 | A1 | 1/2012 | Karatzis | |
| 2017/0341845 | A1 * | 11/2017 | Mulvey | B65D 23/0892 |

FOREIGN PATENT DOCUMENTS

| | | | | |
|---|---|---|---|---|
| EP | 2216259 | A1 * | 8/2010 | B65D 23/104 |
| EP | 2216259 | A1 | 8/2010 | |
| GB | 1223027 | A | 2/1971 | |

OTHER PUBLICATIONS

EP-2216259-A1 English Translation (Year: 2010).*
Italian Search Report in IT 201900007968 dated Mar. 2, 2020.
European Search Report in EP 20177643 dated Oct. 30, 2020.

* cited by examiner

*Primary Examiner* — King M Chu
(74) *Attorney, Agent, or Firm* — Manelli Selter PLLC; Edward Stemberger

(57) ABSTRACT

The device for protecting frangible articles comprises a base portion (11) suitable to abut a lower surface of a frangible article (2); a lateral portion (12) shaped as a mesh, suitable to cover lateral portions of said frangible article (2) and extending from the base portion (11); and an attachment portion (13) suitable to be attached to an upper portion of the frangible article (2), connected to the upper end of said lateral portion (12). The device (1) is made of a material selected between ethylene vinyl acetate and paperboard.

20 Claims, 7 Drawing Sheets

DEVICE FOR PROTECTING FRANGIBLE ARTICLES

TECHNICAL FIELD OF THE INVENTION

The present invention refers to a device for protecting frangible articles and to a method of engaging such device to a frangible article.

PRIOR ART

Protecting devices for protecting frangible articles from shocks, particularly when they are transported, are known in the art.

It is considered for example the transportation of wine bottles contained in paperboard boxes. A known approach for protecting the bottles consists of inserting paperboard sheets among the bottles. However, such approach does not duly protect them because it is not capable of protecting the bottles from shocks from the outside of the box and does not absorb the shocks among the bottles. Brisk and uncontrolled movements of the bottle containing cartons, for examples a drop, cause some of or all the bottles contained in a carton to be broken.

It was envisaged a device known as "secure box" for better protecting bottles contained in paperboard boxes. The secure box comprises a paperboard box provided with spacers made also of paperboard. Such paperboard elements are obtained by folding pre-die cut paperboard pieces which are in turn inserted around corresponding bottle portions.

This approach enables to improve the protection of the bottle, by separating them from each other and from the walls of the paperboard box, enabling to prevent shocks among them and from the outside, unfortunately this approach has further disadvantages.

Particularly, the elements of the secure box must be manually assembled on the bottles. The operations for assembling a single secure box require a time of about three minutes. This assembling time is long and for example inconvenient for wineries which must ship large quantities of bottles. Indeed, the secure box approach is not considered by wineries, but only by logistic companies.

Another problem of the secure box is the impossibility of reducing the assembly times, because equipment or devices enabling to automatically assembly them do not exist. The assembly can be only made by hand, which is, as said, time consuming.

Moreover, the secure box cannot be customized, because is used by logistic companies, as hereinbefore said. Logistic companies do not offer the possibility of placing, for example, a winery identifying sign on the boxes, before selling them, for example when they are ordered.

BRIEF SUMMARY OF THE INVENTION

Consequently, the object of the present invention consists of providing a device for protecting frangible articles and a method of engaging such device to a frangible article, ensuring an effective protection from any type of shocks when transporting them.

Another object of the present invention consists of providing a device for protecting frangible articles which can be easily and readily assembled on the frangible articles. Consequently, engaging the device to the frangible article is effortless.

This and other objects are met by a device for protecting frangible articles and by a method of engaging such device to a frangible article according to the attached claims.

The device substantially comprises a base portion suitable to abut a lower surface of a frangible article, a lateral portion extending from the base, shaped as a mesh and adapted to cover lateral portions of the frangible article, and an attachment portion connected to the upper end of the lateral portion and suitable to be attached to an upper portion of the frangible article. The device is made of a material suitable to absorb shocks. Optionally, the device is made of ethylene vinyl acetate or paperboard.

According to the method, the base portion, lateral portion and attachment portion of the device are suitably oriented to each other in order to enable the device to engage to a frangible article. For the purpose of such engagement, the upper portion of the frangible article is substantially locked by attachment means, such as two fins.

According to a particularly advantageous embodiment, the mesh shaped lateral portion is provided with a plurality of segments having a thickness greater than 2 mm.

Dependent claims define possible advantageous embodiments of the invention.

Moreover, the invention refers, independently from the device for protecting frangible articles, to a gripping device associatable to a portion of a frangible article, such as a bottle neck, and configured to transport said frangible article.

BRIEF DESCRIPTION OF THE DRAWINGS

In order to gain a better comprehension of the invention and appreciating the advantages thereof, some exemplifying non-limiting embodiments of the invention will be described in the following by referring to the attached figures, wherein.

DESCRIPTION OF THE EMBODIMENTS OF THE INVENTION

Figure 1:
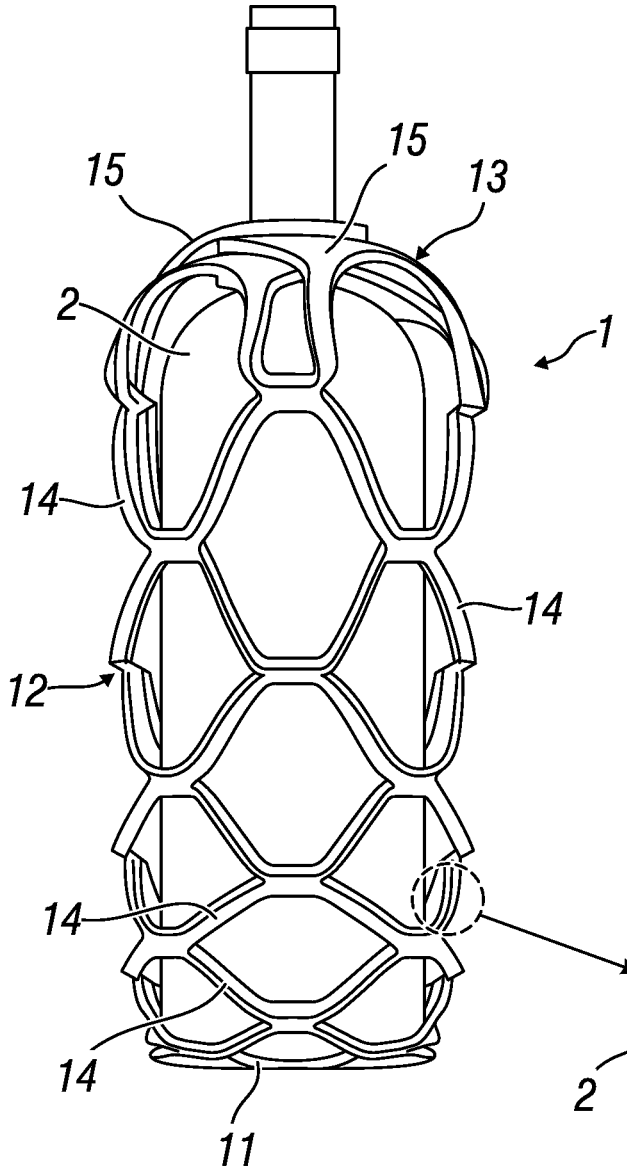
FIG. 1 is a lateral view of a device for protecting a frangible article according to the invention assembled to said frangible article (gripping configuration)

A device for protecting frangible articles according to the invention is indicated in the attacked figures by reference 1.

The attached figures show the device 1 mounted to a glass bottle, e.g. a wine bottle, anyway device 1 can be used for protecting a variety of frangible objects made also of different materials, such as glasses or pots, or frangible objects of different dimensions, such as statues.

Generally, the protecting device 1 comprises a body 10, in turn comprising a base portion 11 adapted to abut a lower surface of a frangible article 2, a mesh-shaped lateral portion 12 suitable to cover lateral portions of the frangible article 2, lateral portion 12 extending from base portion 11, and an attachment portion 13 adapted to be attached to an upper portion of the frangible article and connected to the upper end of the lateral portion 12. The base portion 11, lateral portion 12 and attachment portion 13 are suitably orientable from each other and with respect to the frangible article 2 in order to take the hereinbefore described arrangement and therefore enabling the device 1 to engage to the frangible article 2.

In other words, the body 10 is configured to operate between a rest configuration (see FIG. 2) and a gripping configuration in which it securely stably holds the frangible article (see FIG. 1). The body 10 is substantially flat in the rest configuration and the lateral portion 12, base portion 11 and attachment portion 13 are substantially coplanar to each other, while in the gripping configuration the lateral portion 12, base portion 11 and attachment portion 13 are oriented to each other. The body 10 is configured to transition from the rest configuration to the gripping configuration, and vice versa, by relatively orienting the lateral portion 12, base portion 11 and attachment portion 13 to each other.

Consequently, the protecting device 1 is stably mounted to the article 2 and does not come apart from it when is handled, and at least partially or mainly or completely covers its body.

Referring back to the example of FIG. 1, the base portion 11 of the device 1 abuts the lower surface of the bottle bottom, the mesh shaped lateral portion 12 covers the lateral wall of the bottle around the whole circumference thereof, and the attachment portion 13 is attached to the bottle neck.

It is appropriate providing a base portion 11 having a shape and dimensions substantially like the shape and dimensions of the lower surface of the article 2 to be protected. Specifically, the dimensions are preferably slightly greater than the ones of the article 2 lower portion.

It is observed that the lateral portion 12, shaped as a mesh, comprises a plurality of segments 14 making a mesh defining openings of predetermined shapes, for example square or substantially hexagonal openings, as in the example of FIG. 1.

Figure 2:
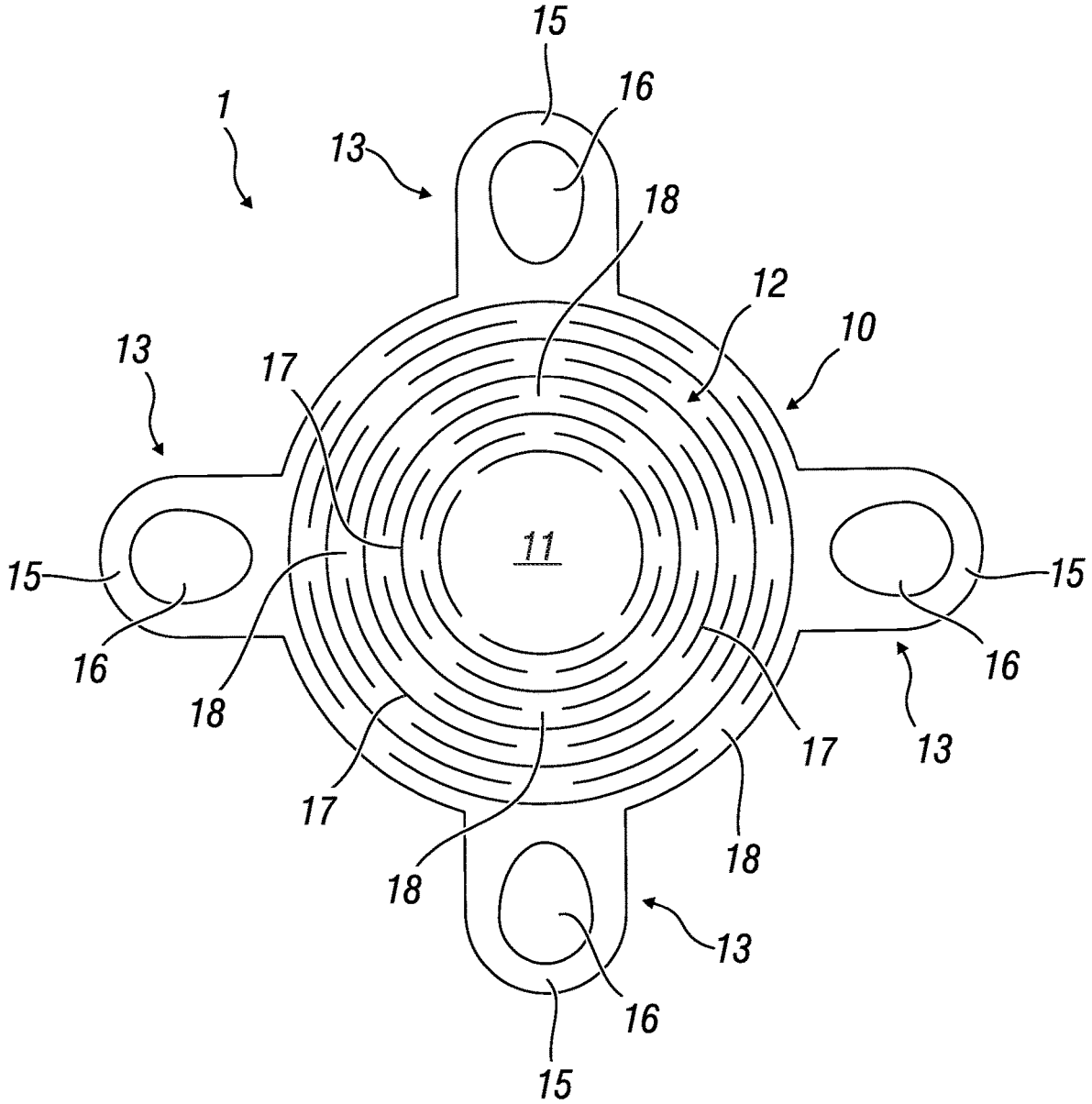
FIG. 2 is a plan view of the device according to the invention before assembling it to a frangible article (rest configuration)

The attachment portion 13 comprises, instead, means 15 for attaching to an upper portion of the article 2. Advantageously, such means 15 comprise at least two fins each provided with an attachment member 16. In the example of FIGS. 1 and 2, the attachment portion 13 comprises four fins 15 provided with a corresponding through hole 16 adapted to receive the bottle neck but not the bottle body. As illustrated in FIG. 1, the fins 15 are superimposable to each other in order to stably lock the bottle, by the attachment members 16, on the bottle neck. As illustrated in FIG. 1, when the fins 15 are superimposed, the bottle neck passes through the respective through holes 16 of the fins 15. Fins 15 enable the engagement between the device 1 and frangible article 2 to be safe, stable and reliable.

Clearly, the attachment member 16 can be of any type according to the kind of article 2, for example can be implemented by pliers or adhesive substances.

According to the present invention, the device 1 is made of a material suitable to absorb shocks. Preferably, the shock absorbing material is selected between ethylene vinyl acetate (EVA) and paperboard. The term "paperboard" means any type of paperboard, however corrugated paperboard is the preferred one.

Advantageously, EVA is flexible, elastic, impervious to fungi and bacteria, an allergic and nontoxic, and mechanically not slippery, which makes the article 2 more stable when it is individually transported. On the contrary, paperboard besides being strong has the advantage of being recyclable. In case the device 1 is made of EVA, it is possible to couple it with a layer of another material which can be selected on an aesthetic or functional basis. For example, the EVA device can be covered by a layer made of leather, fabric, paperboard or another flexible material.

According to an advantageous aspect of the invention, the segments 14 of the lateral portion 12 have a thickness greater than 2 mm. More preferably, the segments 14 have a thickness greater than 3 mm. Indeed, it was found that with a thickness smaller than 2 mm, the shock absorbing action allowed by the mesh shaped lateral portion 12 is less effective.

Within the present patent application, the term "thickness" means the distance, considered perpendicular to the surface of a frangible article 2 to a point, between the internal surface (facing the article 2) and external surface of a segment 14 of the lateral portion 12.

Typically, if the article 2 is a bottle as illustrated in the drawings, the thickness of the segments is of about 4 or 5 mm. Clearly, such value can vary according to the needs, and particularly as a function of the dimensions and weight of the article 2 to be protected.

Figure 1A:
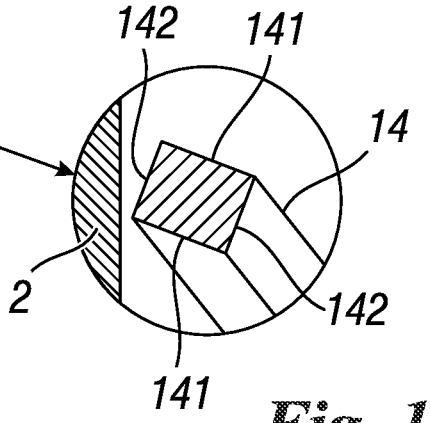
FIG. 1A is a cross-section view of a detail of FIG. 1.

According to another advantageous aspect, the segments 14 of the lateral portion 12 have a quadrilateral shape (FIG. 1A). Consequently, segments 14 form a protective layer around the lateral portion of the frangible article 2 and the thickness of this protective is such to effectively absorb shocks. Such protection cannot be obtained by segments having for example a flat cross-section.

Preferably, the quadrilateral cross-section of segments 14 of lateral portion 12 has two first sides 141 opposite to each other and two second sides 142 opposite to each other (FIG. 1A). The length of each pair of sides 141, 142 is respectively equal to L1, L2. Advantageously, the length L1, L2 of one of the first sides 141 and second sides 142 is greater than the length L2, L1 of the other between the first sides 141 and second sides 142 of no more of the quadruple (L2<=L1<=4L2).

Advantageously, the cross-section of the segments 14 is in the shape of a square or a rectangle.

Preferably, the segments are oriented so that their sides 141, 142 are sloped with respect to the lateral portion of the frangible article (referring particularly to FIG. 1A). The thickness (as hereinbefore defined) of the segment 14 is greater, for a benefit of a more effective protection of the frangible article 2. More particularly, sides 141, 142 are advantageously sloped with an angle substantially equal to 45° with respect to the lateral portion of the article 2.

According to a possible embodiment of the protection device 1, the base portion 11, lateral portion 12 and attachment portion 13 are made in a single piece (the body 10, as shown in FIG. 2). This makes simpler, faster and less expensive manufacturing the protection device 1.

In this case it is advantageous to provide the body 10 with a plate shape (FIG. 2) wherein the lateral portion 12 is arranged between the base portion 11 and attachment portion 13.

In the example of FIG. 2, the base portion 11 is disposed in a central position, surrounded by the lateral portion 12 and then by the attachment portion 13 consisting of the four above mentioned fins 15.

Slits 17 are made in the lateral portion 12 and are longitudinally oriented with respect to the base portion 11 and/or attachment portion 13 and are radially distributed with respect to the plate-shaped body center 10. Since the illustrated base portion 11 has a circular shape, preferably also the slits have a circular shape and are concentric to the base portion 11 itself. However, the slits 17 can possibly have different shapes and orientations in order to obtain openings having different shape and dimension according to the needs.

It is particularly advantageous to obtain by the slits 17, segments 14 connected to each other so that they can radially extend with respect to the body 10 center.

For this purpose, slits 17 are not continuous along the same circumference, because the base portion 10 would be separated from the rest of the body 10. Advantageously, the slits 17 and interruptions 18 are alternately disposed, where two different segments 14 are reciprocally joined.

In the illustrated example, the slits 17 are curved and represent concentric circles each comprising a plurality of interruptions 18, or solid sectors. In the example of FIG. 2, each circle comprises four solid sectors 18, however any number varying according to the needs and dimensions of the device 1 can be provided. The detachment or breakage of segments 14 is prevented by solid sectors 18 having a length at least equal to the width of segments 14 (in other words to the distance between two consecutive slits 17 when is radially considered with respect to the body 10 center). More preferably, the solid sectors 18 have a length substantially twice the distance between two consecutive slits 17.

It is observed that the plate-shaped body 10 provided with slits 17 for obtaining the segments of the lateral portion 12 implies that the length of one among the first and seconds sides 141, 142 corresponds to the plate-shaped body 10 thickness, while the length of the other between the first and second sides 141, 142 corresponds to the distance between two slits 17, considered radially with respect to the body 10 center. Consequently, it is possible to simply select the dimensions of segments 14 by adjusting the body 10 thickness and the distance between slits 17.

Figure 3:
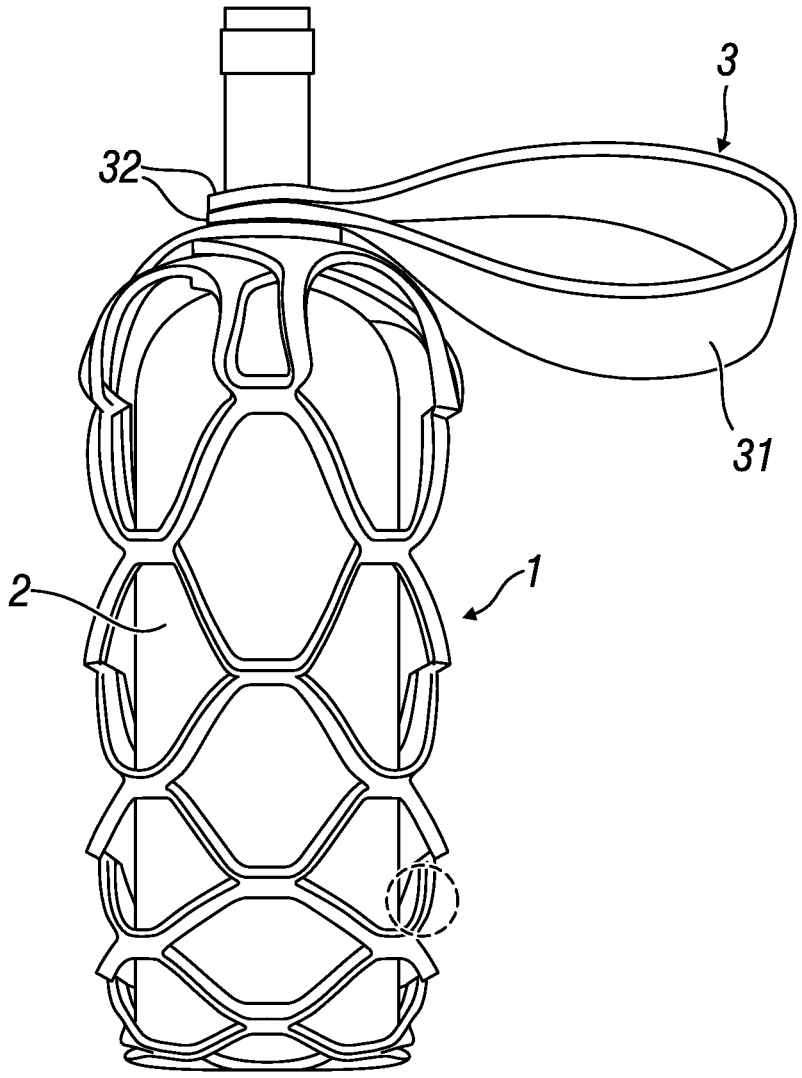
FIG. 3 is a lateral view of a supplementary element of the device, mounted to a bottle.
Figure 4:
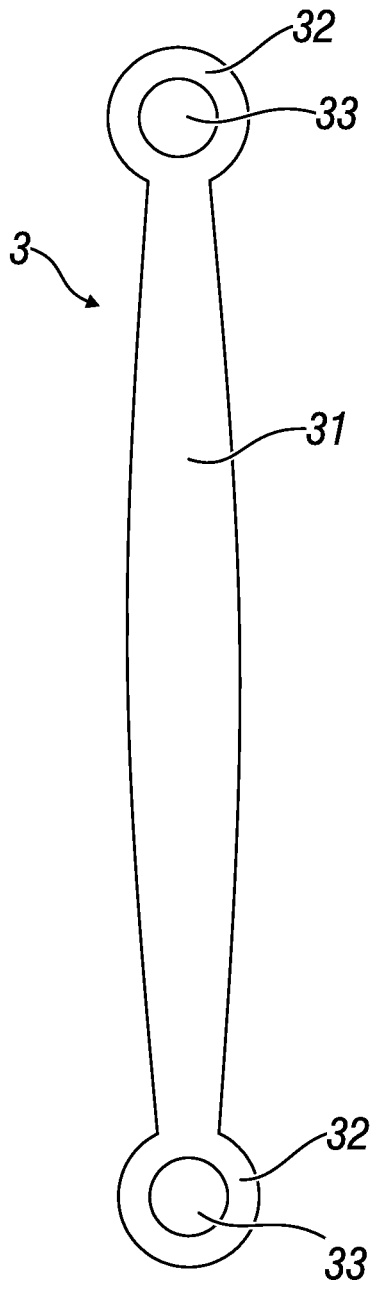
FIG. 4 is a plan view of the supplementary element of FIG. 3, before mounting it.

FIGS. 3 and 4 illustrate a device 3 for gripping a frangible article 2, associatable to the hereinbefore described protection device 1. It is observed that the gripping device 3 is an independent element, and therefore can be used without the protection device 1 (because is not integrally made with it) for carrying the article 2.

The gripping device 3 is connectable to a portion of the article 2 and is made of a material suitable to absorb shocks, preferably selected between ethylene vinyl acetate and paperboard, as said before with reference to the protection device 1.

The gripping device 3 comprises a body 30 and at least two connection portions 32 connectable to a portion of article 2. In the illustrated example, each connection portions 32 comprises a connection member 33, for example a through opening 33 having a size such to be capable of inserting the bottle neck but not the body thereof, in the same way as said with reference to the attachment portion 13 of the protection device 1.

Advantageously, the body 31 has an elongated shape, in order to form a gripping portion such as a strap or loop, when the connection portions 32 are connected to the article 2, as shown in FIG. 3. Clearly, the connection portions 32 are arranged at the ends of the body 31.

The body 31 can be coated by a reinforcing layer made of a material selected according to the needs.

The operation of the protection device 1 can be understood from the above given description and is the following. The method of engaging the previously described device 1 to a frangible article 2 is described below.

The protection device 1 is provided in its flat shape (rest configuration) as shown in FIG. 2. The frangible article 2 is placed by abutting it on the central portion of the body 10, which corresponds to the base portion 11 in the illustrated example.

Then, the attachment means 15, in this case the fins 15, are gripped and taken to the upper part of article 2 in order to attach them to the same (attaching step). The attaching step is executed by superimposing the fins 15. Such upward displacement of the attachment means 15 causes the lateral portion 12 to be stretched, which in turn enlarges the slits 17 so that they become the openings shown in FIG. 1. In the illustrated embodiment wherein the frangible article 2 is a bottle, the step of attaching the attachment means 15 provides to insert the bottle neck through the respective through hole 16 of each fin 15.

During the stretching of the lateral portion 12, segments 14 are subjected to a slight rotation, of about 45°, and are placed sloped with respect to the article 2, in other words their sides 141, 142 are sloped with respect to the article 2 surface in that point. This rotation of the segments 14 is due to the fact that the stretching is in a direction transversal (upwardly) to the direction where the slits 17 are (horizontally) distributed.

It is observed that during the step of displacing the attachment means 15, the body 10 is fixedly held by the article 2 abutting the base portion 11.

Once the attachment portion 13 is attached to the upper part of article 2, in other words in the illustrated example, when the fins 15 are disposed around the bottle neck, the assembly of the protection device 1 is finished, and the frangible article can be safely transported.

If a user desires to transport the article 2 by hand by the gripping device 3, he/she will connect a first connection portion and then the second connection portion 32 to the article 2 upper part. The second portion 32 can be connected to the article 2 by the two body 31 ends from the same side of the article 2, as shown in FIG. 3, in order to obtain a gripping loop on the article 2 side. As an alternative, the two body 31 ends can be each disposed at a respective opposite side of article 2, in order to obtain a gripping loop placed above the article 2.

Therefore, it is understood that the protection device 1 has a simple structure and can be easily and quickly assembled around a frangible article 2. The manual assembly requires few seconds for a glass bottle. The device 1 and the method according to the invention enable to protect a frangible article 2 simply, quickly and simultaneously safely, stably and reliably. Further, the simplicity by which the device 1 is assembled enables to design an automatic machine for performing this step, further decreasing the assembly times. Consequently, the protection device 1 can be advantageous for wineries which can also customize it by affixing their trademark to it.

Figure 5:
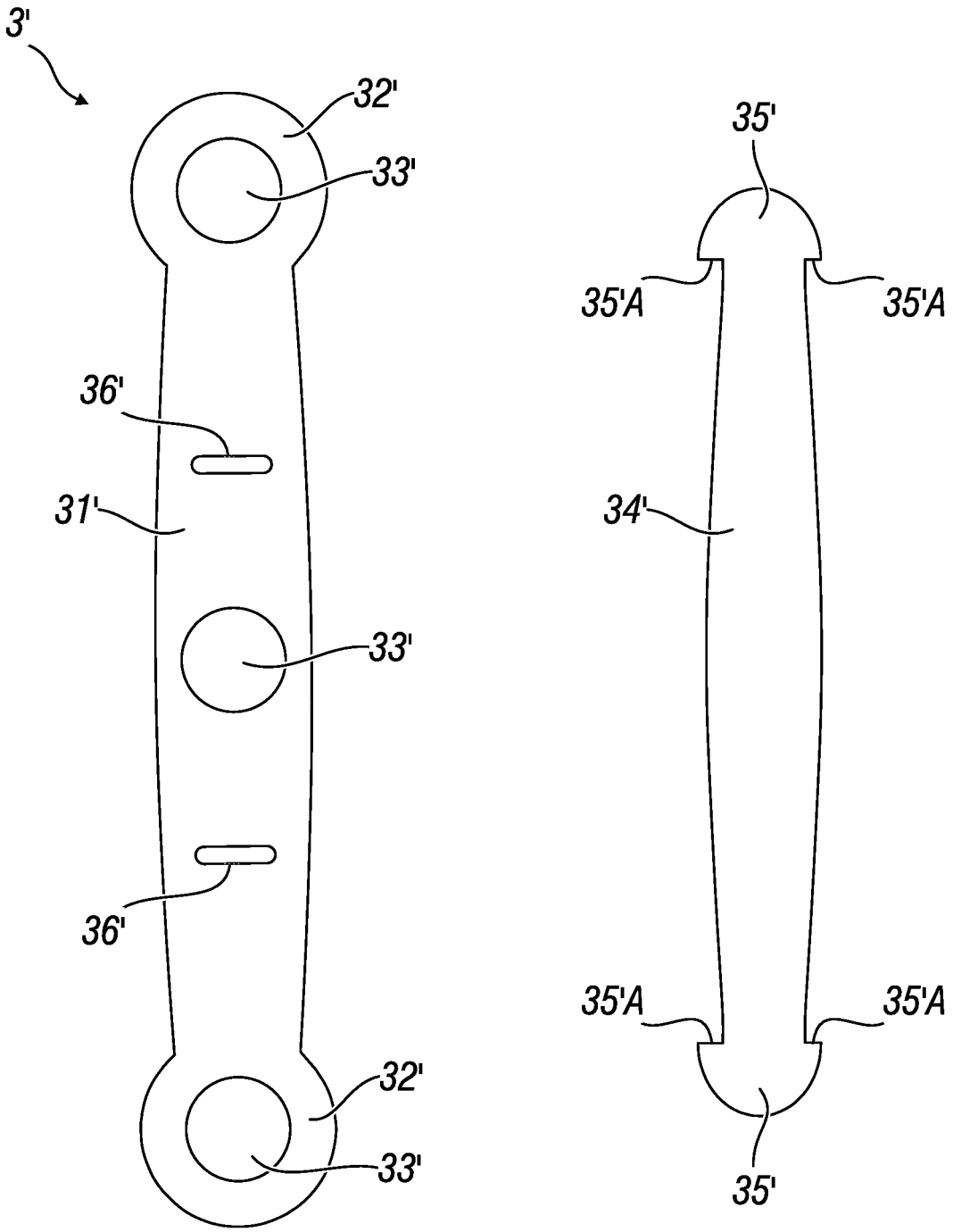
FIGS. 5, 6 and 7 are plan views of three variants of the supplementary element of FIG. 3, before mounting them.
Figure 6:
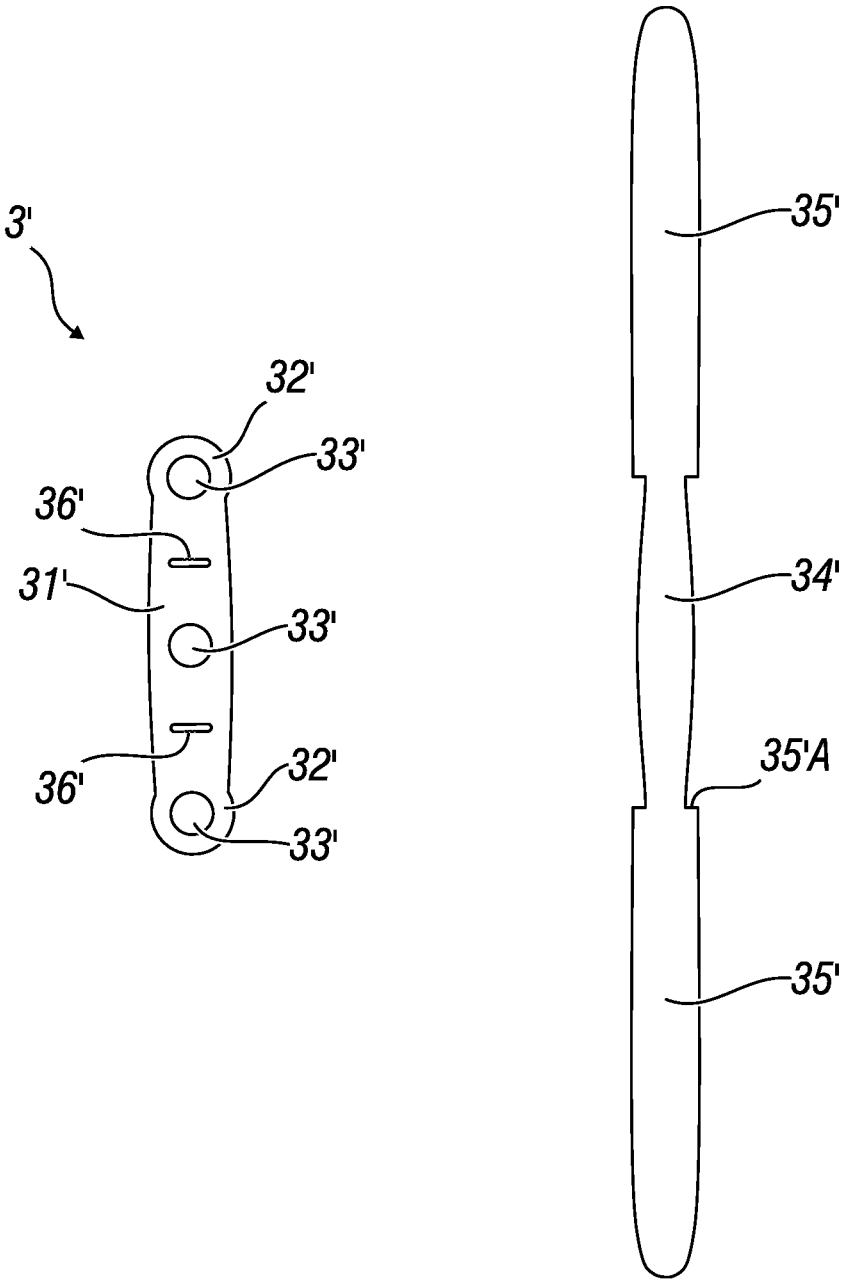

FIGS. 5 and 6 represent a variant of the gripping device 3 shown in FIGS. 3 and 4. The parts common to the first variant will not be described and will be indicated by the same reference number with the addition of a prime.

In this second variant, the body 31' comprises, besides the connection members 33' of the two connection portions 32', a third connection member 33' substantially centrally disposed with respect to the connection portions 32'. Consequently, three articles 2 can be connected. Particularly, in case of glass bottles, each connection member 33' can comprise a through opening 33'.

The gripping device 3' comprises also a gripping member 34' having a preferably elongated shape and connectable to the body 31', for example by suitable coupling members 35' adapted to cooperate with coupling countermembers 36' disposed on the body 31'. In the example of FIG. 5, the coupling members 35' comprise tooth-shaped portions disposed at the ends of the gripping member 34', while the coupling countermembers 36' comprise slits made in the body 31' at intermediate positions between the central connecting member 33' and connecting portions 32'.

Teeth 35' particularly comprise a pair of abutment surfaces 35'A suitable to abut the body 31' after conventionally inserting the teeth into slits 36'.

In FIG. 5, teeth 35' have a substantially semicircular shape and a limited length. On the opposite, in FIG. 6, teeth 35' have an elongated shape and a length at least equal to or also greater than the length of the gripping member 34'. Such elongated teeth 35' are disposed between the bottles, when the gripping member 34' is coupled to the body 31', and consequently acts as a protection partition absorbing the shocks between bottles.

Figure 7:
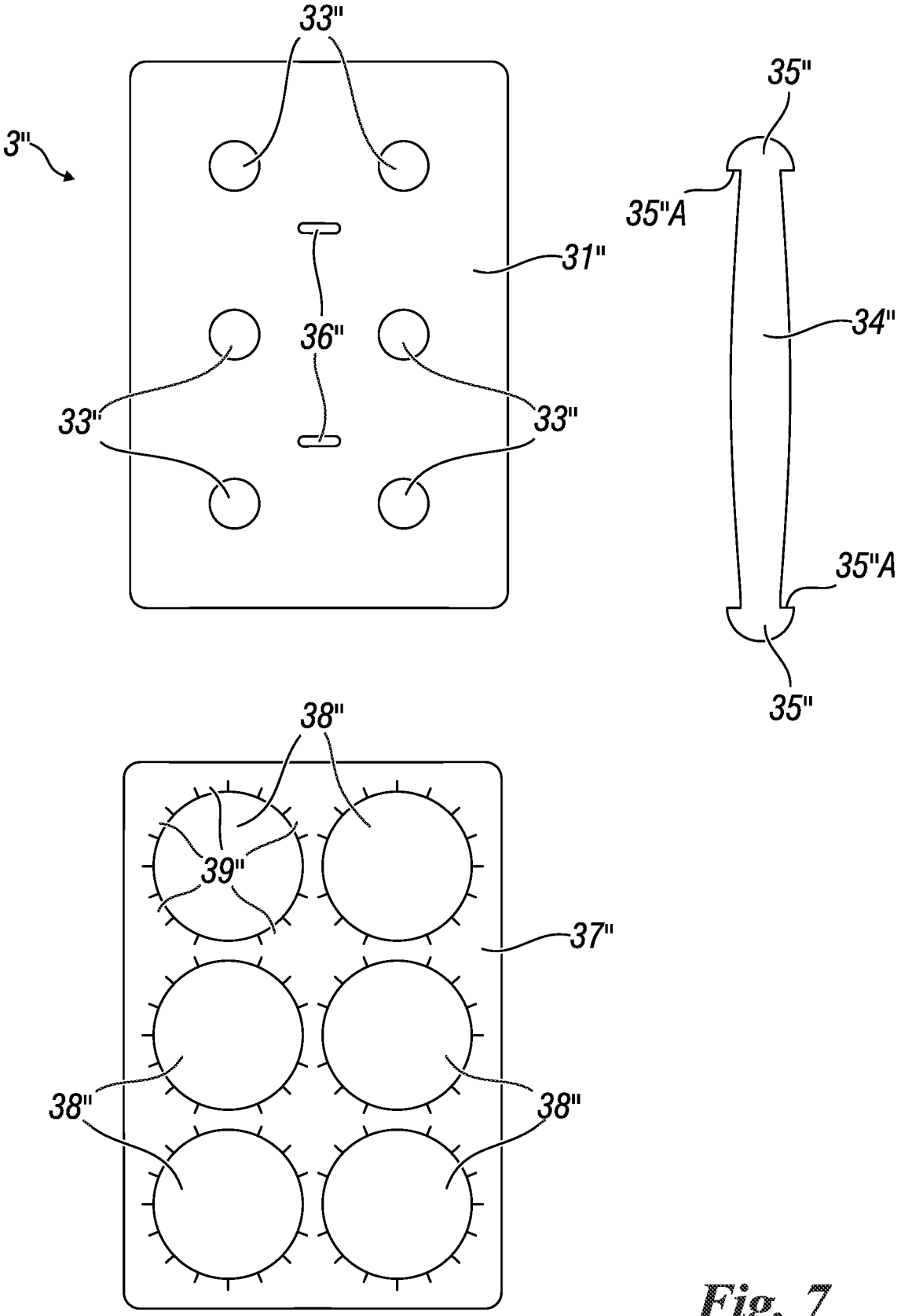

FIG. 7 illustrates a second variant of the gripping device 3 shown in FIGS. 3 and 4. Parts common to the first variants will not be described and are indicated by the same reference number, with the addition of two primes.

The body 31" is substantially in the shape of a rectangle and comprises six connection members 33". It is observed that this number can vary according to the number of articles 2 one wishes to transport. Besides the gripping member 34", the gripping device 3" can also comprise a second body 37" having substantially the same shape as the body 31" and provided with six seats 38" adapted to receive a lower portion of article 2.

In the illustrated example, each seat 38" comprises a through opening with a dimension such to enable the passage of a bottle body. Advantageously, these openings 38" are provided with foldable fins 39" on the internal edge for stably inserting the bottles.

A person skilled in the art in order to meet specific contingent needs can introduce many additions, modifications, or substitutions of elements with other operatively equivalent ones to the described embodiments of the protection device according to the invention without falling out of the scope of the attached claims.

The invention claimed is:

1. Device (1) for protecting frangible articles, comprising:

a base portion (11) suitable to abut a lower surface of a frangible article (2), a lateral portion (12) shaped as a mesh, said lateral portion (12) being suitable to cover lateral portions of said frangible article (2) and extending from said base portion (11), and an attachment portion (13) suitable to be attached to an upper portion of said frangible article (2), connected to the upper end of said lateral portion (12) of the device, wherein the device (1) is made of a material suitable to absorb shocks, wherein the lateral portion (12) of the device is provided with a plurality of segments (14), the cross-section thereof having quadrilateral shape, and wherein the quadrilateral cross-section of the segments (14) of the lateral portion (12) of the device has two first sides (141) opposite to each other and two second sides (142) opposite to each other and connected to the two first sides (141), wherein the length (L1, L2) of one of the first sides (141) and second sides (142) is greater than the length (L2, L1) of the other two sides (141, 142) of no more than the quadruple (L2<=L1<=4*L2).

2. Device according to claim 1, wherein the lateral portion (12) of the device is provided with a plurality of segments (14), the thickness thereof being greater than 2 mm.

3. Device according to claim 1, wherein the segments (14) of the lateral portion (12) of the device have a rectangular or square cross-section.

4. Device according to claim 1, wherein the base portion (11), the lateral portion (12) of the device and the attachment portion (13) are in a single piece.

5. Device according to claim 1, made of material selected between ethylene vinyl acetate and paperboard.

6. Device according to claim 1, further comprising a gripping device (3, 3', 3") connectable to a portion of the frangible article (2), the gripping device (3, 3', 3") being made of a material selected between ethylene vinyl acetate and paperboard.

7. Device (1) for protecting frangible articles, comprising:

a base portion (11) suitable to abut a lower surface of a frangible article (2), a lateral portion (12) shaped as a mesh, said lateral portion (12) being suitable to cover lateral portions of said frangible article (2) and extending from said base portion (11), and an attachment portion (13) suitable to be attached to an upper portion of said frangible article (2), connected to the upper end of said lateral portion (12) of the device, wherein the device (1) is made of a material suitable to absorb shocks, the device further comprising a plate-shaped body (10) wherein the lateral portion (12) of the device is disposed between the base portion (11) and the attachment portion (13).

8. Device according to claim 7, wherein the segments (14) of the lateral portion (12) of the device are obtained by making slits (17) longitudinally oriented with respect to the base portion (11) and/or to the attachment portion (13) and radially distributed with respect to the center of the plate-shaped body (10).

9. Device according to claim 7, wherein the body (10) is configured to operate between a rest configuration and a gripping configuration in which the body hold said frangible article (2), the body (10) being configured to transition from the rest configuration to the gripping configuration by relative orientation between lateral portion (12) of the device, base portion (11), and attachment portion (13).

10. Device according to claim 7, wherein the base portion (11), the lateral portion (12) of the device and the attachment portion (13) are in a single piece.

11. Device according to claim 7, made of material selected between ethylene vinyl acetate and paperboard.

12. Device according to claim 7, further comprising a gripping device (3, 3', 3") connectable to a portion of the frangible article (2), the gripping device (3, 3', 3") being made of a material selected between ethylene vinyl acetate and paperboard.

13. Method of engaging a device (1) for protecting frangible articles to a frangible article (2), the method comprising at least the following steps:

providing a device comprising a base portion (11) suitable to abut a lower surface of a frangible article (2), a lateral portion shaped as a mesh, said lateral portion (12) being suitable to cover lateral portions of said frangible article (2) and extending from said base portion (11), and an attachment portion (13) suitable to be attached to an upper portion of said frangible article (2), connected to the upper end of said lateral portion (12) of the device, the attachment portion (13) comprises at least two fins (15), each provided with an attachment member (16), the device (1) being made of a material suitable to absorb shocks, abutting, by the base portion (11), a lower surface of said frangible article (2), covering lateral portions of said frangible article (2) by the lateral portion (12) of the device, and attaching the attachment portion (13) to an upper portion of said frangible article (2).

14. Method according to claim 13, wherein the step of attaching the attachment portion (13) to the upper portion of said frangible article (2) comprises:

bringing the at least two fins (15) at or close to said upper portion of said frangible article (2), and attaching said at least two fins (15) to said upper portion of said frangible article (2) by the attachment members (16).

15. Method according to claim 13, wherein the step of providing the device (1) provides the device (1) in a rest condition.

16. Method according to claim 13, wherein said frangible article (2) is a bottle and the step of attaching said at least two fins (15) to said upper portion of said frangible portion (2) by the attachment members (16) comprises causing a neck of said bottle to at least partially pass through a respective attachment member (16) of each fin (15).

17. Device (1) for protecting frangible articles, comprising:

a base portion (11) suitable to abut a lower surface of a frangible article (2), a lateral portion (12) shaped as a mesh, said lateral portion (12) being suitable to cover lateral portions of said frangible article (2) and extending from said base portion (11), and an attachment portion (13) suitable to be attached to an upper portion of said frangible article (2), connected to the upper end of said lateral portion (12) of the device, wherein the device (1) is made of a material suitable to absorb shocks, wherein the attachment portion (13) comprises at least two fins (15), each fin being provided with an attachment member (16).

18. Device according to claim 17, wherein said at least two fins (16) are superimposable to each other in order to take a superimposed configuration in which they are configured to lock said frangible article (2) by the attachment members (16) gripping the upper portion of said frangible article (2).

19. Device according to claim 17, wherein the base portion (11), the lateral portion (12) of the device and the attachment portion (13) are in a single piece.

20. Device according to claim 17, made of material selected between ethylene vinyl acetate and paperboard.

* * * * *